US011371398B2

(12) United States Patent
Matsuura et al.

(10) Patent No.: US 11,371,398 B2
(45) Date of Patent: Jun. 28, 2022

(54) OIL SUPPLY STRUCTURE FOR TIMING CHAIN SYSTEM

(71) Applicant: Mazda Motor Corporation, Hiroshima (JP)

(72) Inventors: Hirokazu Matsuura, Higashihiroshima (JP); Michihiro Yamauchi, Hatsukaichi (JP)

(73) Assignee: Mazda Motor Corporation, Hiroshima (JP)

( * ) Notice: Subject to any disclaimer, the term of this patent is extended or adjusted under 35 U.S.C. 154(b) by 554 days.

(21) Appl. No.: 16/463,036

(22) PCT Filed: Oct. 17, 2017

(86) PCT No.: PCT/JP2017/037529
§ 371 (c)(1),
(2) Date: May 22, 2019

(87) PCT Pub. No.: WO2018/096842
PCT Pub. Date: May 31, 2018

(65) Prior Publication Data

US 2020/0063615 A1 Feb. 27, 2020

(30) Foreign Application Priority Data

Nov. 25, 2016 (JP) ..... JP2016-229049
Nov. 25, 2016 (JP) ..... JP2016-229050

(51) Int. Cl.
*F01M 9/10* (2006.01)
*F01L 1/02* (2006.01)
(Continued)

(52) U.S. Cl.
CPC ..... *F01M 9/105* (2013.01); *F01L 1/022* (2013.01); *F01M 1/08* (2013.01); *F01M 11/02* (2013.01);
(Continued)

(58) Field of Classification Search
CPC ..... F01M 9/105; F01M 1/08; F01M 11/02; F01M 2011/021; F01L 1/022; F01L 2250/02; F01L 2810/02
See application file for complete search history.

(56) References Cited

U.S. PATENT DOCUMENTS 4,752,279 A * 6/1988 Ogino ..... F16H 57/05 74/467
2007/0277760 A1 12/2007 Inaba et al.
(Continued)

FOREIGN PATENT DOCUMENTS

DE 10021220 A1 10/2001
DE 102004005797 A1 5/2006
(Continued)

*Primary Examiner* — Syed O Hasan
(74) *Attorney, Agent, or Firm* — Alleman Hall Creasman & Tuttle LLP

(57) ABSTRACT

An engine is provided with a timing chain cover that covers a side where a timing chain is arranged in a spaced apart manner from the side of the engine. An oil jet extending in an output shaft direction is a hollow member including therein an oil passage. One end portion of the oil jet in the output shaft direction is supported in a hole formed in the engine, and the other end portion of the oil jet extends toward the timing chain cover but does not come into contact with the timing chain cover. A pressing part arranged in a spaced apart manner from the timing chain cover in the output shaft direction is located between the other end portion and the timing chain cover in the output shaft direction, and the pressing part is in contact with the other end portion.

8 Claims, 7 Drawing Sheets

(51) Int. Cl.
*F01M 1/08* (2006.01)
*F01M 11/02* (2006.01)

(52) U.S. Cl.
CPC ..... *F01L 2250/02* (2013.01); *F01L 2810/02* (2013.01); *F01M 2011/021* (2013.01)

(56) References Cited

U.S. PATENT DOCUMENTS

| | | | | |
|---|---|---|---|---|
| 2007/0277761 | A1 | 12/2007 | Takada et al. | |
| 2008/0173275 | A1 | 7/2008 | Koyama | |
| 2013/0109517 | A1* | 5/2013 | Tiernan | F16H 57/05 184/15.1 |
| 2017/0037956 | A1* | 2/2017 | Mishima | F01M 1/06 |

FOREIGN PATENT DOCUMENTS

| | | | |
|---|---|---|---|
| EP | 0699849 | A | 3/1996 |
| JP | H04134107 | A | 5/1992 |
| JP | H08061081 | A | 3/1996 |
| JP | H08093890 | A | 4/1996 |
| JP | 2000282829 | A | 10/2000 |
| JP | 2004346895 | A | 12/2004 |
| JP | 2007321642 | A | 12/2007 |
| JP | 2007321747 | A | 12/2007 |
| JP | 2008175138 | A | 7/2008 |
| JP | 2013142318 | A | 7/2013 |

* cited by examiner

OIL SUPPLY STRUCTURE FOR TIMING CHAIN SYSTEM

TECHNICAL FIELD

The present invention relates to an oil supply structure for a timing chain system provided to an engine or the like.

BACKGROUND ART

As described in the following Patent Document 1, there has been known, as a means for fixing an oil jet without using bolts, a configuration in which a pressing part extending along an output shaft of an engine is provided to a timing chain cover so as to press a portion opposite to a cylinder block-side end of the oil jet.

Furthermore, the following Patent Document 2 describes a configuration in which an oil jet is arranged in the vicinity of a meshing point between a crankshaft sprocket wheel and a timing chain, and an end of the oil jet that is remote from a cylinder block is supported on a timing chain cover.

CITATION LIST

Patent Document

PATENT DOCUMENT 1: Japanese Unexamined Patent Publication No. 2004-346895 (see FIG. 13)

PATENT DOCUMENT 2: Japanese Unexamined Patent Publication No.2000-282829 (see FIG. 1)

SUMMARY OF THE INVENTION

Technical Problem

In the invention described in Patent Document 1, the end portion of the oil jet that is adjacent to the cylinder block (hereinafter, also simply referred to as a block) is attached to an engine body. Consequently, a vibration generated when the engine is in operation may be transmitted to the timing chain cover via the oil jet, and the timing chain cover may emit a radiation sound.

As a method for reducing the emission of the radiation sound, it is conceivable to rigidly fasten, to the block with a bolt or the like, a vibration source (i.e., the peripheral portion of the pressing part in Patent Document 1) that transmits a vibration to the timing chain cover.

However, if the oil jet is intended to be arranged close to the timing chain in order to reliably supply the oil injected from the oil jet to the timing chain, it is difficult to provide a boss hole for bolt fastening in the proximity of the oil jet due to the positional relation between the timing chain and the sprocket wheel.

On the other hand, on the assumption that the invention of Patent Document 2 is applied to the so-called rear chain system in which a timing chain system is arranged adjacent to the transmission, a flywheel fastening plate is arranged at a position on an output shaft of the engine, the position being closer to the transmission than the sprocket wheel is, and facing the cover surface of the timing chain cover. In such a case, the cover surface is provided with a plate support that supports the flywheel fastening plate in a rotatable manner, and hence, it is impossible to elongate the outer shape of the oil jet so that the oil jet is supported on the timing chain cover, as described in Patent Document 2.

Here, in the invention described in Patent Document 1, if the pressing part is intended to be elongated from the timing chain cover, the pressing part needs to be formed from a radially outer side of a plate support, undesirably resulting in not only complication of the shape of the pressing part, but also an increase in the overall length of the engine body.

The present invention has been made to overcome the above-mentioned conventional drawbacks. It is an object of the present invention to enable an oil jet to be supported without using a bolt while reducing emission of a radiation sound from a timing chain cover. It is also an object of the present invention to achieve an oil supply structure for a timing chain system that is capable of supporting the oil jet, while avoiding dependence on a structure in a vicinity of the timing chain and the oil jet, and an increase in an overall length of an engine body.

Solution to the Problem

To achieve the above object, the present invention provides a configuration in which: a timing chain cover is arranged in a spaced apart manner from a side, of an engine body, where a timing chain is arranged; a pressing part is arranged at a predetermined distance from the timing chain cover; and an end portion, of an oil jet, which is remote from a cylinder block is pressed by the pressing part.

Specifically, the present invention is directed to an oil supply structure for a timing chain system, and takes the following measures.

That is, a first aspect of the present invention is directed to an oil supply structure for a timing chain system including: a timing chain configured to be driven by an output shaft of an engine body; and an oil jet configured to supply oil to the timing chain. The engine body is provided with a timing chain cover covering a side, of the engine body, where the timing chain is arranged, the timing chain cover being spaced apart from the side of the engine body. The oil jet is a hollow member extending in an output shaft direction in which the output shaft of the engine body extends, the oil jet including therein an oil passage. One end portion of the oil jet in the output shaft direction of the engine body is supported in a support hole formed in the engine body, whereas an other end portion of the oil jet in the output shaft direction of the engine body extends toward the timing chain cover to an extent that the other end portion of the oil jet does not come into contact with the timing chain cover. A pressing part spaced apart from the timing chain cover in the output shaft direction is arranged between the other end portion of the oil jet and the timing chain cover in the output shaft direction, and the pressing part is in contact with the other end portion of the oil jet.

As can be seen, the timing chain cover covers an engine while being arranged in a spaced apart manner from the side where the timing chain is arranged, and at the same time, the pressing part spaced apart from the timing chain cover in the output shaft direction is arranged between the outer end portion of the oil jet and the timing chain cover, the pressing part being in contact with the outer end portion of the oil jet. Consequently, a vibration generated when the engine is in operation can be prevented from being transmitted to the timing chain cover via the oil jet, thereby reducing emission of a radiation sound from the timing chain cover. Furthermore, the pressing part is in contact with the other end portion (outer end portion) of the oil jet, and hence, the number of working processes of the assembly of the engine is not increased.

In addition, the other end portion of the oil jet is in contact with, and supported on, the pressing part arranged in a spaced apart manner from the timing chain cover in the output shaft direction. Thus, the oil jet can be supported without depending on a structure in the vicinity of the timing chain and the oil jet, and without increasing the overall length of the engine body.

A second aspect of present invention is an embodiment of in the first aspect. In the second aspect, the engine body has a chain guide configured to guide traveling of the timing chain, and the pressing part is formed integrally with the chain guide.

With this configuration, in which the pressing part is formed integrally with the chain guide, additional parts for forming the pressing part are no longer necessary.

A third aspect of the present invention is an embodiment of the second aspect. In the third aspect, as viewed from above the engine body, one end, of the pressing part, which is adjacent to the chain guide is more spaced apart from the engine body than an other end of the pressing part is.

With this configuration, in which one end of the pressing part that is adjacent to the chain guide is more spaced apart from the engine body than the other end of the pressing part is, the pressing part is in contact with the other end portion of the oil jet, while being displaced relative to the other end portion of the oil jet in the direction away from the engine body (in an outward direction). As a result, a pressing force that acts on the oil jet in the axial direction of the oil jet is easily generated, enabling the oil jet to be supported appropriately.

A fourth aspect of the present invention is an embodiment of the second or third aspect. In the fourth aspect, the pressing part is comprised of a plate member.

With this configuration, in which the pressing part is comprised of a plate member that laterally presses the other end portion of the oil jet, the pressing part acts as a leaf spring. That is, the pressing part uses the action of leaf spring to press the other end portion of the oil jet with a suitable force.

A fifth aspect of the present invention is an embodiment of the fourth aspect. In the fifth aspect, as viewed from above the engine body, the other end of the pressing part is displaced toward the timing chain cover in the output shaft direction relative to the one end of the pressing part.

With this configuration, the pressing part is in contact with the other end portion of the oil jet at an angle corresponding to the displacement toward the timing chain cover side in the output shaft direction. As a result, a pressing force that acts on the oil jet in the axial direction of the oil jet is easily generated, enabling the oil jet to be supported appropriately.

A sixth aspect of the present invention is an embodiment of the second aspect. In the sixth aspect, the chain guide has a bolt hole via which the chain guide is fastened to the engine body, the bolt hole is arranged in a portion of the chain guide, the portion is close to the other end portion of the oil jet, and the pressing part extends from a part close to the bolt hole.

With this configuration, the action of leaf spring can be obtained further effectively particularly when the pressing part is comprised of a plate member.

A seventh aspect of the present invention is an embodiment of the second aspect. In the seventh aspect, the pressing part has a width substantially equal to a width of the other end portion of the oil jet.

With this configuration, the pressing part can be formed in a compact shape. Even when the area surrounded by the timing chain is narrow, the pressing part having such a compact shape can be arranged outside an area where the timing chain flutters.

An eighth aspect of the present invention is an embodiment of the first aspect. In the eighth aspect, the timing chain meshes with a first sprocket wheel arranged on the output shaft, and the oil jet is arranged in a vicinity of a meshing point between the timing chain and the first sprocket wheel.

This configuration, in which the distance from the oil jet to the first sprocket wheel and the timing chain can be reduced, makes it possible to lower the hydraulic pressure of an oil pump. As a result, improvement of the fuel consumption of the engine can be achieved.

A ninth aspect of the present invention is an embodiment of the first aspect. In the ninth aspect, the timing chain system is arranged on a transmission attaching side provided on one end of the engine body in the output shaft direction, the side of the engine body where the timing chain is arranged has a first sprocket wheel arranged on one end of the output shaft, and a flywheel fastening plate arranged on the output shaft and being closer to a transmission than the first sprocket wheel is, the first sprocket wheel and the flywheel fastening plate being located between the engine body and the timing chain cover in the output shaft direction, and the oil jet is arranged to overlap with the flywheel fastening plate as viewed in the output shaft direction.

With this configuration, the present invention is also applicable to the so-called rear chain system in which the timing chain system is arranged on a side adjacent to the transmission.

A tenth aspect of the present invention is an embodiment of the ninth aspect. In the tenth aspect, a second sprocket wheel coaxial with the first sprocket wheel is arranged between the first sprocket wheel and the flywheel fastening plate, and in the output shaft direction of the engine body, the other end portion of the oil jet is located closer to the engine body than the second sprocket wheel is.

With this configuration, the other end portion of the oil jet that is located outward is not positioned above the second sprocket wheel remote from the engine body, but positioned above the first sprocket wheel close to the engine body. Thus, the oil jet can be formed to have a small length. As a result, the durability of the oil jet pressed by the pressing part and the engine body can be ensured.

Advantages of the Invention

According to the present invention, an oil supply structure for a timing chain system can be achieved, the oil supply structure being capable of supporting the oil jet without using a bolt while reducing emission of a radiation sound from the timing chain cover and, at the same time, being capable of supporting the oil jet without depending on the structure in the vicinity of the timing chain, the oil jet, and the like, and without increasing the overall length of the engine body.

DESCRIPTION OF EMBODIMENTS

Embodiments of the present invention will be described in detail below with reference to drawings. Note that the embodiments described below are merely preferred examples in nature, and are not intended to limit the scope, application, or uses of the present invention.

(First Embodiment)

The first embodiment of the present invention will be described with reference to the drawings.

Figure 1:
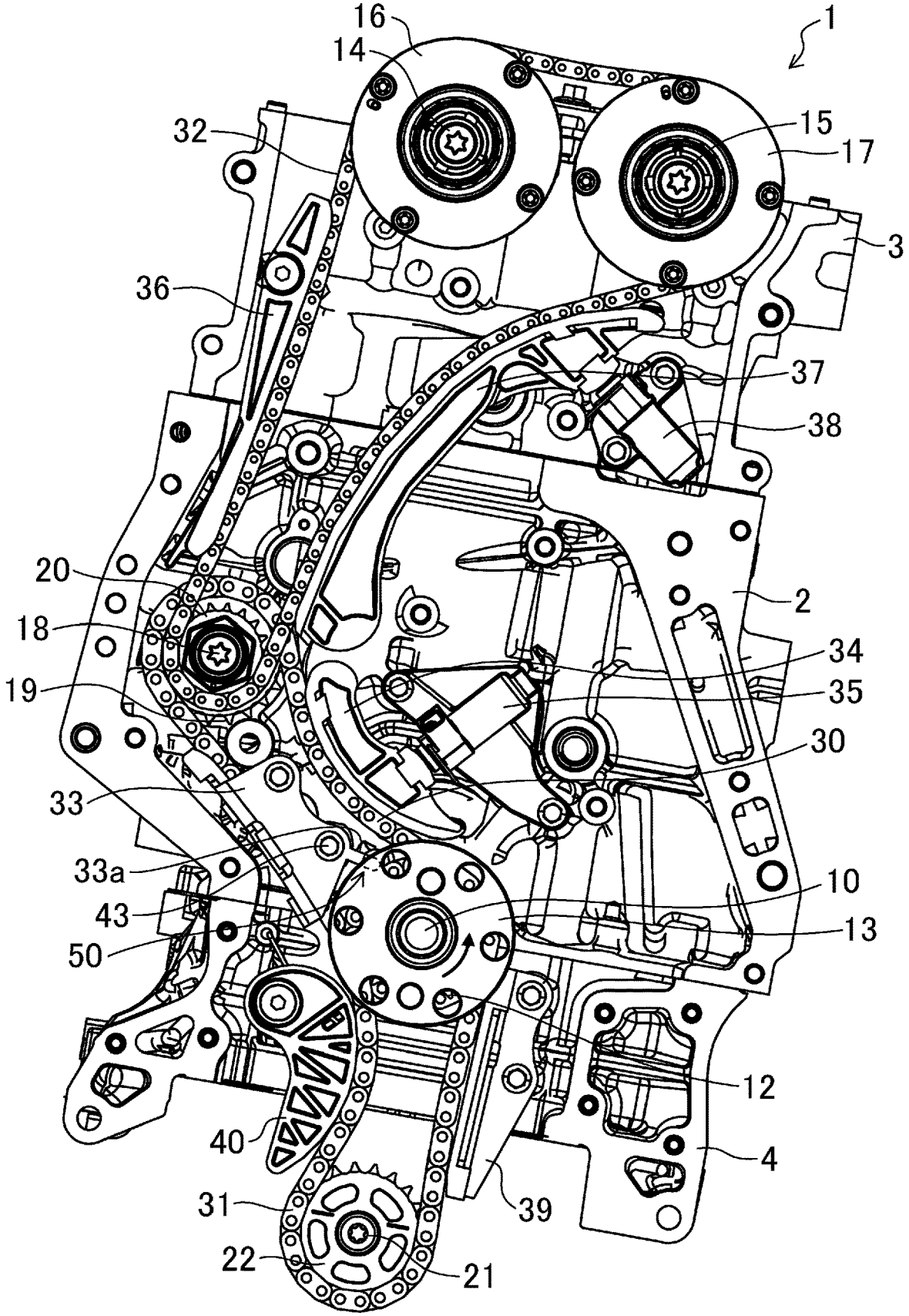
FIG. 1 is a side view illustrating a transmission-facing side of an engine for a vehicle, the engine including an oil supply structure for a timing chain system according to a first embodiment of the present invention, with a timing chain cover omitted therefrom.

FIG. 1 illustrates a transmission-facing side of an engine for vehicle, the engine including an oil supply structure for a timing chain system. Note that a timing chain cover that covers driving chains such as a timing chain is not illustrated in FIG. 1.

As illustrated in FIG. 1, the engine 1 is an example of an engine body, and configured as, for example, a spark ignition internal combustion engine. Although not illustrated in the drawings, the engine 1 is transversely mounted in an engine compartment located in a front portion of a vehicle. However, the engine 1 may be a longitudinally mounted. The engine 1 may include any number of cylinders. For example, the engine 1 is a four-cylinder in-line engine. The engine 1 includes a cylinder block 2 and a crankshaft 10 that is arranged in a lower portion of the cylinder block 2 and functions as an output shaft. The crankshaft 10 is coupled to driving wheels via a transmission (not illustrated). The crankshaft 10 is provided, on an end portion thereof, with the following components sequentially arranged from the engine 1: a crankshaft sprocket wheel 11 (see FIG. 6) as a first sprocket wheel around which a timing chain 30 is wrapped, an oil pump chain sprocket wheel 12 as a second sprocket wheel around which an oil pump chain 31 is wrapped, and a flywheel fastening plate 13 fastened to a flywheel (not illustrated) with a plurality of bolts, the flywheel being coupled to the transmission and other components. As can be seen, in this embodiment, the so-called rear chain system in which the timing chain 30 is arranged adjacent to the transmission is adopted.

A cylinder head 3 coupled to the upper side of the cylinder block 2 is provided with an inlet camshaft 14 and an exhaust camshaft 15 that extend parallel to each other in the axial direction of the crankshaft 10. An inlet cam sprocket wheel 16 and an exhaust cam sprocket wheel 17 are attached to an end of the inlet camshaft 14 and an end of the exhaust camshaft 15, respectively. At least one of the inlet cam sprocket wheel 16 or the exhaust cam sprocket wheel 17 may be provided with a variable valve timing (VVT) mechanism.

The cylinder block 2 is provided, in a side portion thereof, with a fuel pump drive shaft 18, a fuel pump sprocket wheel 19 attached to a portion, of the fuel pump drive shaft 18, which is adjacent to the cylinder block 2, and a cam chain sprocket wheel 20 attached to a portion, of the fuel pump drive shaft 18, which is located outside with respect to the fuel pump sprocket wheel 19.

The timing chain 30 is wrapped around the crankshaft sprocket wheel 11 and the fuel pump sprocket wheel 19. Furthermore, a cam chain 32 is wrapped around the inlet cam sprocket wheel 16, the exhaust cam sprocket wheel 17, and the cam chain sprocket wheel 20.

A lower cylinder block 4 is coupled to the lower side of the cylinder block 2. An oil pump drive shaft 21, and an oil pump sprocket wheel 22 attached to the oil pump drive shaft 21 are arranged below the lower cylinder block 4.

A timing chain guide 33 that guides the traveling of the timing chain 30 in a tension-side span between the crankshaft 10 and the fuel pump drive shaft 18 is attached to the cylinder block 2. The timing chain guide 33 has, at its end close to a bolt 43 located adjacent to the crankshaft 10, a pressing part 33*a* extending from the end to the vicinity of a meshing point between the timing chain 30 and the crankshaft sprocket wheel 11. An oil jet 50 is provided adjacent to the back side (the side adjacent to the engine body) of the pressing part 33*a*. The oil jet 50 includes therein an oil passage, and injects a lubricant (oil) to the meshing point between the timing chain 30 and the crankshaft sprocket wheel 11. An end portion, of the oil jet 50, which is located adjacent to the cylinder block 2, is fitted in a hole (support hole) which is formed in the cylinder block 2 and in which an oil passage extends. The pressing part 33*a* of the timing chain guide 33 is in contact with an outer end portion of the oil jet 50 (the end remote from the cylinder block 2) so as to support the oil jet 50. Therefore, the end portion of the oil jet 50 that is located outside in the output shaft direction of the engine 1 is out of contact with a timing chain cover 42 (see FIG. 6). The details of configurations of the pressing part 33*a* provided to the timing chain guide 33 and the oil jet 50 according to this embodiment will be described later.

In a loose-side span of the timing chain 30 between the crankshaft 10 and the fuel pump drive shaft 18, a timing chain tensioner (hydraulic auto-tensioner) 35 that gives a tension to a loose side of the timing chain 30 via a timing chain tensioner arm 34 is held on the cylinder block 2.

Likewise, a cam chain guide 36 that guides the traveling of the cam chain 32 in a tension-side span between the fuel pump drive shaft 18 and the inlet camshaft 14 is held on the cylinder block 2. Furthermore, in a loose-side span of the cam chain 32 between the fuel pump drive shaft 18 and the exhaust camshaft 15, a cam chain tensioner (hydraulic auto-tensioner) 38 that gives a tension to a loose side of the cam chain 32 via a cam chain tensioner arm 37 is held on the cylinder block 2.

An oil pump chain guide 39 that guides the traveling of the oil pump chain 31 in a tension-side span between the crankshaft 10 and the oil pump drive shaft 21 is held on the lower cylinder block 4. Furthermore, in a loose-side span of the oil pump chain 31 between the crankshaft 10 and the oil pump drive shaft 21, an oil pump chain tensioner arm 40 that gives a tension to a loose side of the oil pump chain 31 is held on the lower cylinder block 4.

Figure 2:
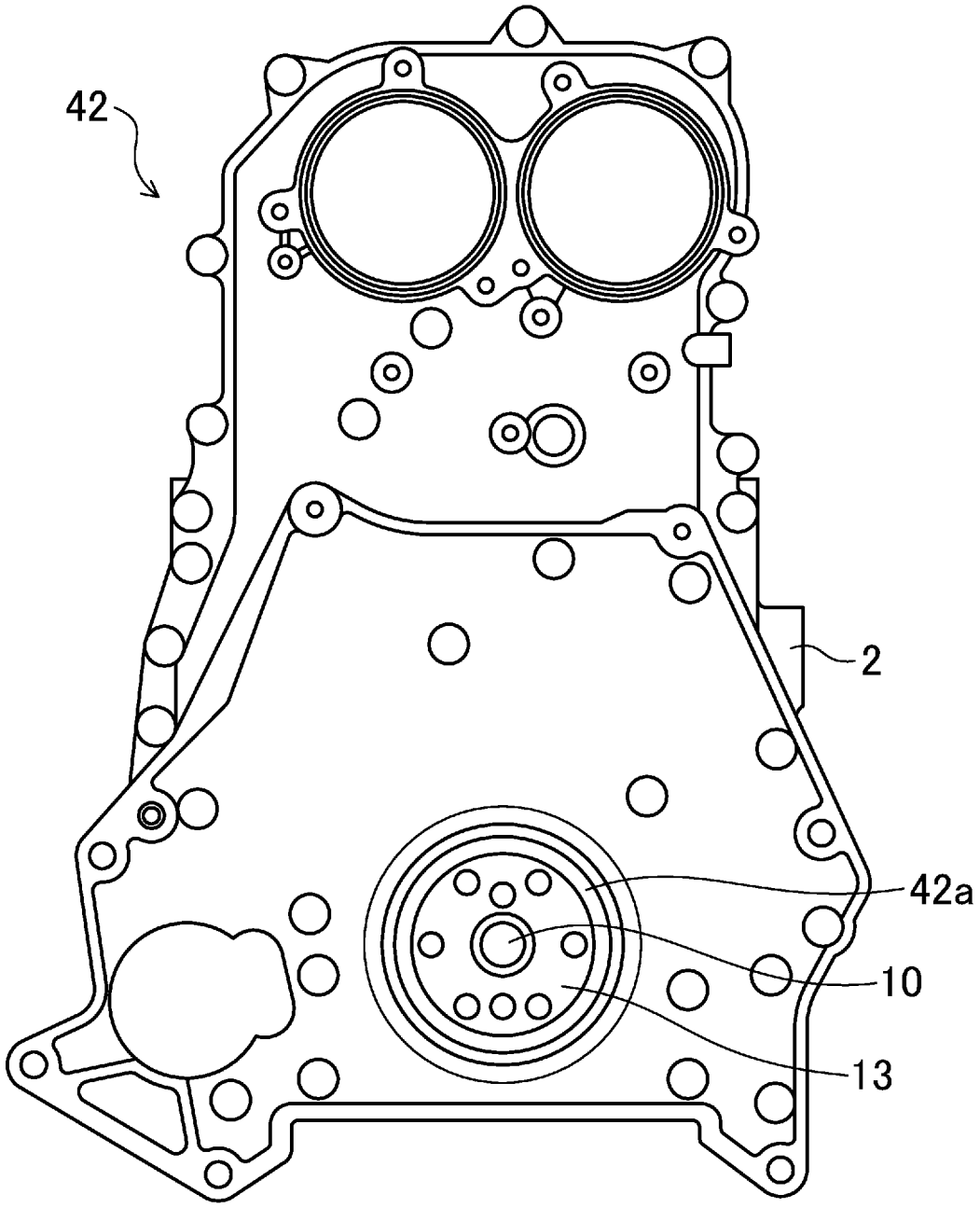
FIG. 2 is a front view illustrating the timing chain cover omitted from FIG. 1.

The engine 1 illustrated in FIG. 1 is usually provided with the timing chain cover 42 illustrated in FIG. 2. The timing chain cover 42 is attached to a side of the engine 1 adjacent to the transmission (transmission attaching side) where the timing chain system is provided, so that the timing chain cover 42 covers the transmission attaching side. The timing chain cover 42 is arranged so as not to be in contact with the chains 30, 31, 32 as well as the chain guides 33, 36, 39, the chain tensioner arms 34, 37, 40, and the chain tensioners 35, 38. The timing chain cover 42 has an opening from which the flywheel fastening plate 13 is exposed. A plate support 42*a* that supports the outer peripheral surface of the flywheel fastening plate 13 in a rotatable manner is arranged on the inner wall surface of the opening.

(Configurations of Pressing Part of Timing Chain Guide, and Oil Jet)

Figure 3:
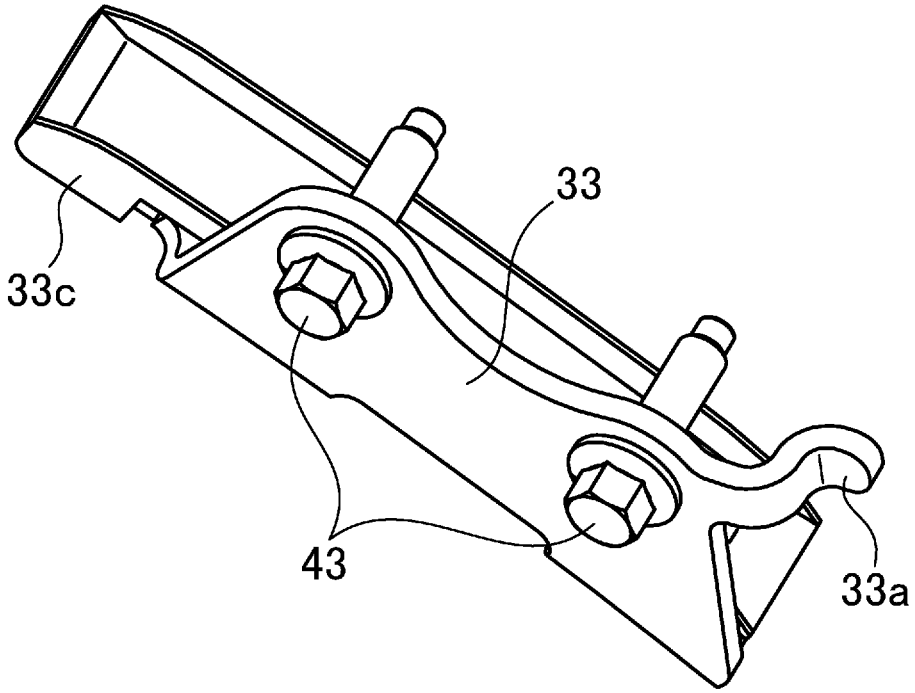
FIG. 3 is a perspective view illustrating a timing chain guide for use in the timing chain system according to the first embodiment of the present invention.
Figure 4:
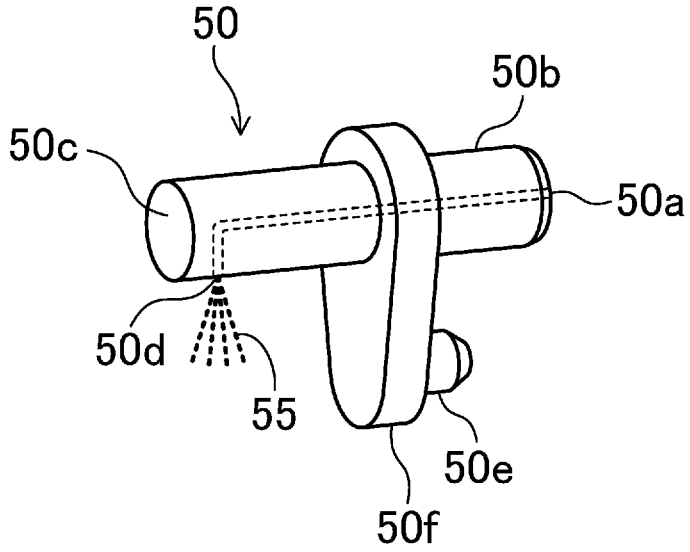
FIG. 4 is a perspective view illustrating an oil jet for use in the timing chain system according to the first embodiment of the present invention.
Figure 5:
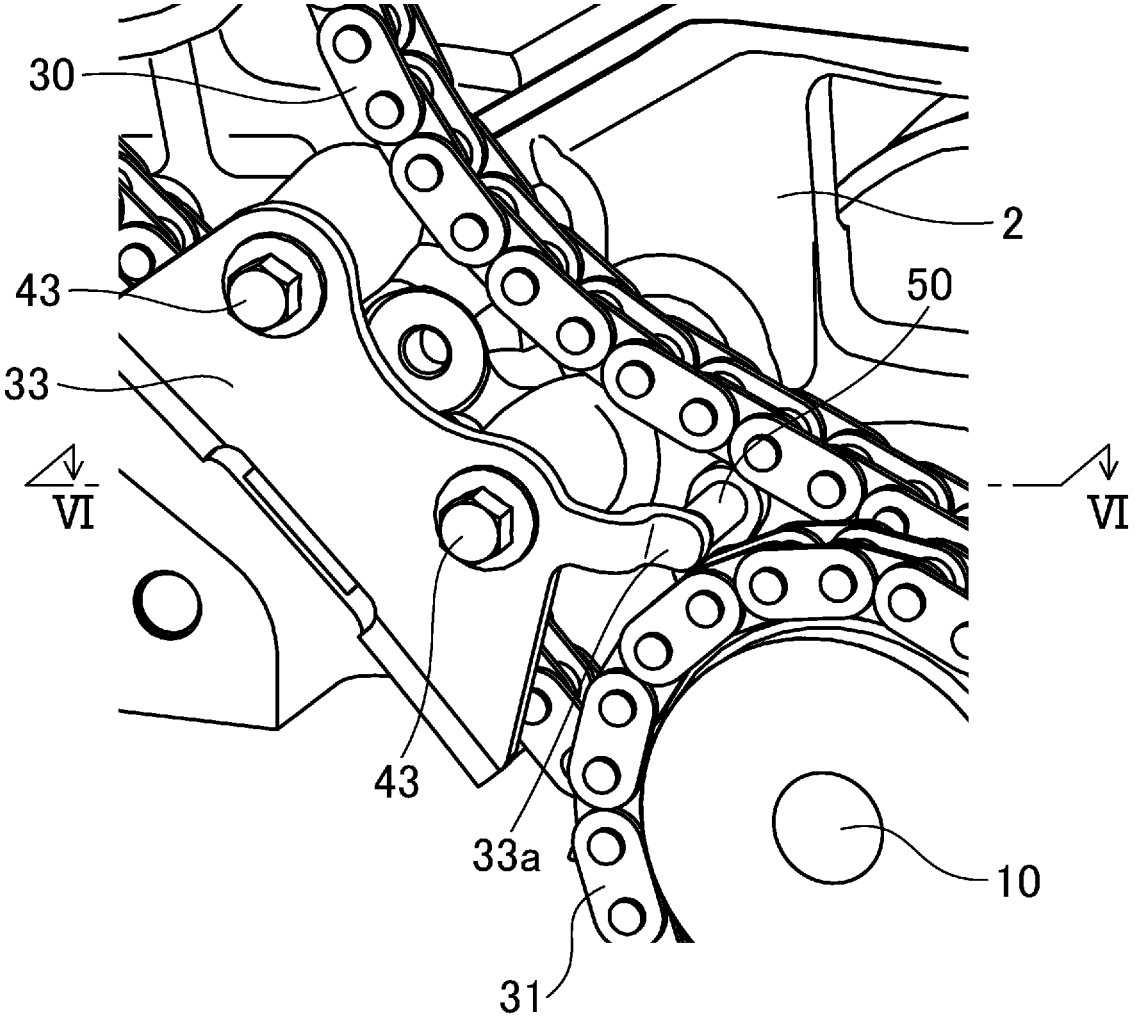
FIG. 5 is a partial perspective view illustrating an area in FIG. 1, the area including the timing chain guide.
Figure 6:
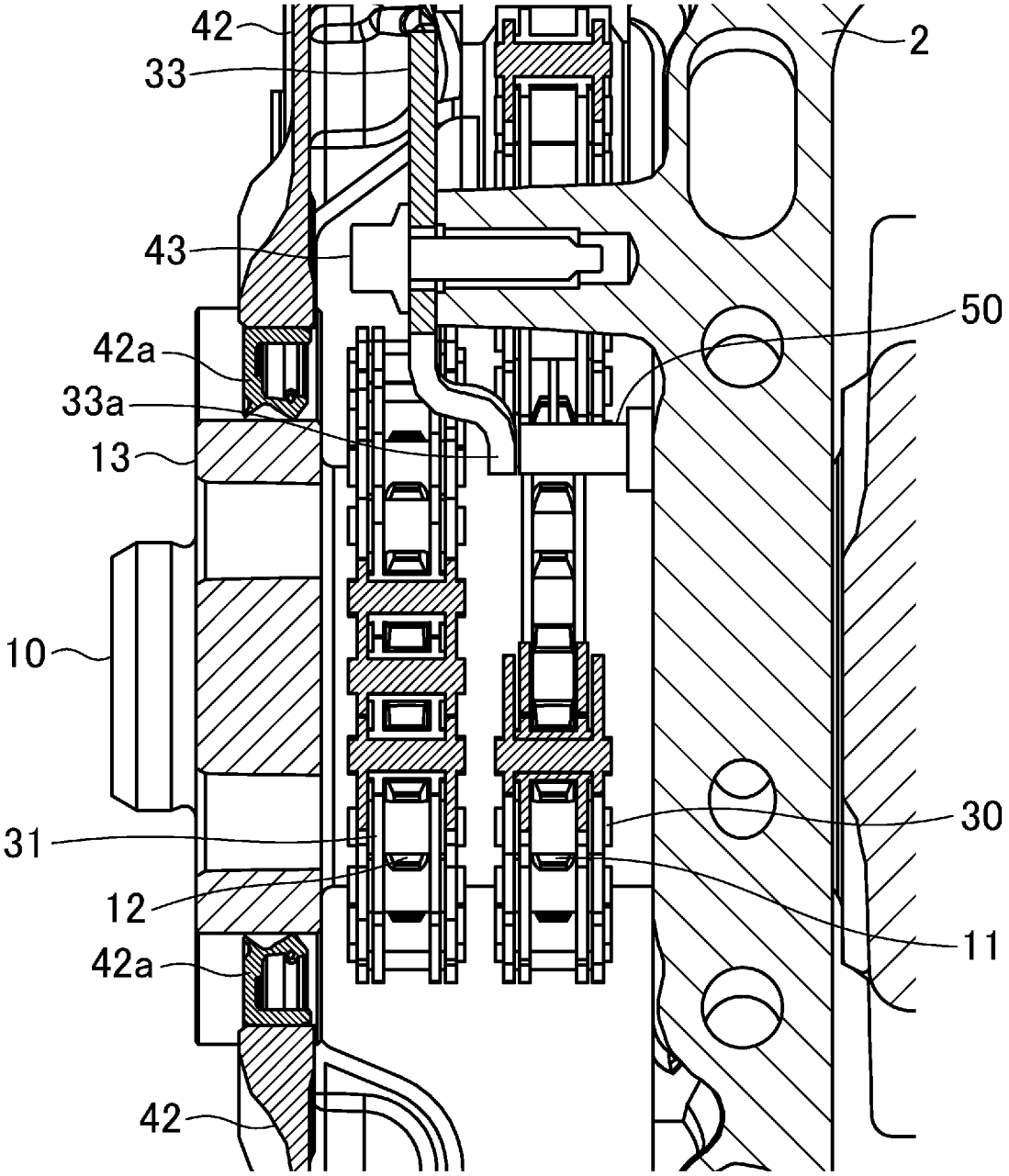
FIG. 6 is a cross-sectional view taken along line VI-VI in FIG. 5 as viewed in the cylinder axial direction.

FIG. 3 illustrates the configuration of the timing chain guide according to this embodiment. FIG. 4 illustrates the configuration of the oil jet according to this embodiment. FIG. 5 is an enlarged perspective view illustrating an area including the timing chain guide 33 and the oil jet 50 that are illustrated in FIG. 1. FIG. 6 is a cross-sectional view taken along line VI-VI in FIG. 5.

As illustrated in FIGS. 1 and 3, the timing chain guide 33 has a sliding part 33*c* that is formed separately from the timing chain guide 33, and guides the traveling of the chain. Furthermore, the timing chain guide 33 has the pressing part 33*a* that extends in a bent manner from an end, of the timing chain guide 33, which is adjacent to the crankshaft 10 toward the back side (side adjacent to the cylinder block 2) of the timing chain guide 33. The pressing part 33*a* has a plate shape and is formed integrally with the timing chain guide 33. The pressing part 33*a* is in contact with the end surface (second end portion 50*c*) of the oil jet 50 at the back surface (surface adjacent to cylinder block 2) of the distal end portion thereof. This configuration makes it possible to prevent the oil jet 50 from falling off from the cylinder block 2 due to a hydraulic pressure. The timing chain guide 33 is attached to the cylinder block 2 of the engine 1 with two bolts 43.

As illustrated in FIG. 4, the oil jet 50 has, for example, the shape of a bottomed cylinder, and includes a first end portion 50*b* having an opening 50*a* communicating with an inner oil passage formed in the cylinder block 2; and a second end portion 50*c* located opposite to the first end portion 50*b* and supported on the pressing part 33*a* of the timing chain guide 33. An oil injection opening 50*d* is formed in a lower surface of the vicinity of the second end portion 50*c* of the oil jet 50, i.e., in the side surface, of the oil jet 50*a*, which is adjacent to the lower cylinder block 4, and oil 55 is injected through the oil injection opening 50*d*. The oil jet 50 has, for example, an anti-rotation holder 50*f* that is formed at an intermediate portion of the side surface of the oil jet 50, extends in the direction in which the oil injection opening 50*d* opens, and holds anti-rotation projection 50*e*. The anti-rotation projection 50*e* is a projection that prevents the rotation of the oil jet 50 having a cylindrical shape and positions the oil jet 50. The anti-rotation projection 50*e* is fitted in a hole of the cylinder block 2.

FIG. 5 is a perspective view illustrating, on an enlarged scale, an area including the timing chain guide 33 in FIG. 1. FIG. 6 is a cross-sectional view taken along line VI-VI in FIG. 5 as viewed in the downward direction of the cylinder axis. As illustrated in FIGS. 5 and 6, the oil jet 50 according to this embodiment is arranged above the meshing point between the timing chain 30 and the crankshaft sprocket wheel 11. Thus, the oil injection opening 50*d* of the oil jet 50 is directed toward the meshing point between the timing chain 30 and the crankshaft sprocket wheel 11. Furthermore, as described previously, the pressing part 33*a* of the timing chain guide 33 is in contact with the second end portion 50*c*, of the oil jet 50, which is remote from the cylinder block 2 so as to support the oil jet 50. In FIG. 5, the flywheel fastening plate 13 arranged on the crankshaft 10 is not illustrated.

On the other hand, FIG. 6 illustrates the flywheel fastening plate 13 and the timing chain cover 42. As illustrated in FIG. 6, in the pressing part 33*a* provided at the timing chain guide 33 and supporting the oil jet 50, the proximal portion of the pressing part 33*a* (the body of the timing chain guide 33; the other end of the pressing part 33*a*) is, as viewed in the cylinder axial direction, displaced outward with respect to the cylinder block 2 (i.e., displaced in a direction away from the engine 1), relative to the distal end (one end) of the pressing part 33*a*. As can be seen, the pressing part 33*a* is in contact with the second end portion 50*c* of the oil jet 50 at an angle corresponding to the outward displacement. Consequently, a pressing force (biasing force) that acts in the longitudinal direction of the oil jet 50 is easily generated, enabling the oil jet 50 to be supported appropriately. Furthermore, the pressing part 33*a* is comprised of a plate member that laterally presses the second end portion 50*c* of the oil jet 50. Thus, the pressing part 33*a* acts as a leaf spring. This makes it possible to press the second end portion 50*c* of the oil jet 50 with a suitable force. Specifically, there may be a case where a hydraulic pressure is applied to the inside of the oil jet 50, generating a force causing the oil jet 50 to be detached in the direction toward the pressing part 33*a* and a case where the oil jet 50 has a length longer than the nominal length due to manufacturing variations. In such cases, the action of leaf spring can substantially prevent an excessive reaction force that acts on the oil jet 50.

Furthermore, as illustrated in FIGS. 3 and 6, the pressing part 33*a* is formed so as to extend from a part close to the bolt 43, making it possible to effectively obtain the action of leaf spring described above. To be more specific, with this configuration, the portion that substantially acts as a leaf spring can be formed to have a small length, and a bolt axial force can be efficiently transmitted to the second end portion 50*c*. This makes it possible to support the oil jet 50 with an appropriate force, in cooperation with the advantageous effect of the leaf spring action.

Furthermore, the pressing part 33*a* is formed to have a width substantially equal to the width of the second end portion 50*c* of the oil jet 50. Consequently, the pressing part 33*a* can be formed in a compact shape. As a result, even when the area surrounded by the timing chain 30 and the crankshaft sprocket wheel 11 is narrow, the pressing part 33*a* can be arranged outside an area where the timing chain 30 flutters. Note that the tops of the bolts 43 of the timing chain guide 33 according to this embodiment are kept out of contact with the timing chain cover 42.

Furthermore, in this embodiment, the crankshaft 10 is provided with the crankshaft sprocket wheel 11 as the first sprocket wheel located adjacent to the engine 1, and the oil pump chain sprocket wheel 12 as the second sprocket wheel located outside with respect to the crankshaft sprocket wheel 11. The oil jet 50 according to this embodiment is arranged in the vicinity of the meshing point of the crankshaft sprocket wheel 11 that is located inward (adjacent to the engine 1). This arrangement reduces the distance from the oil jet 50 to the crankshaft sprocket wheel 11 and the timing chain 30. As a result, oil can be supplied to where the oil is needed more reliably in this embodiment than in a case where the distance from the oil jet 50 to the crankshaft sprocket wheel 11 and the timing chain 30 is long. Consequently, an amount of oil to be supplied to the oil jet 50 can be relatively reduced, thereby lowering the hydraulic pressure of the oil pump.

In addition, as illustrated in FIG. 6, in the case of the rear chain system as in this embodiment, when the oil jet 50 is brought close to the meshing point between the timing chain 30 and the crankshaft sprocket wheel 11, the oil jet 50 is hidden behind the flywheel fastening plate 13 because the diameter of the crankshaft sprocket wheel 11 is smaller than that of the flywheel fastening plate 13. In this regard, in this embodiment, in which the pressing part 33*a* that supports the oil jet 50 is provided not at the timing chain cover 42 but at the timing chain guide 33, the pressing part 33*a* is not obstructed by the flywheel fastening plate 13. Thus, a situation where the overall length of the engine 1 needs to be increased is avoided.

As described above, according to this embodiment, the oil supply structure for the timing chain 30 can be achieved, the oil supply structure being capable of supporting the oil jet 50 without using a bolt or the like, that is, without a dedicated boss hole formed in the cylinder block 2, while reducing emission of a radiation sound from the timing chain cover 42 due to the oil jet 50.

(Second Embodiment)

An oil supply structure for a timing chain system according to a second embodiment of the present invention is described with reference to the drawing.

Figure 7:
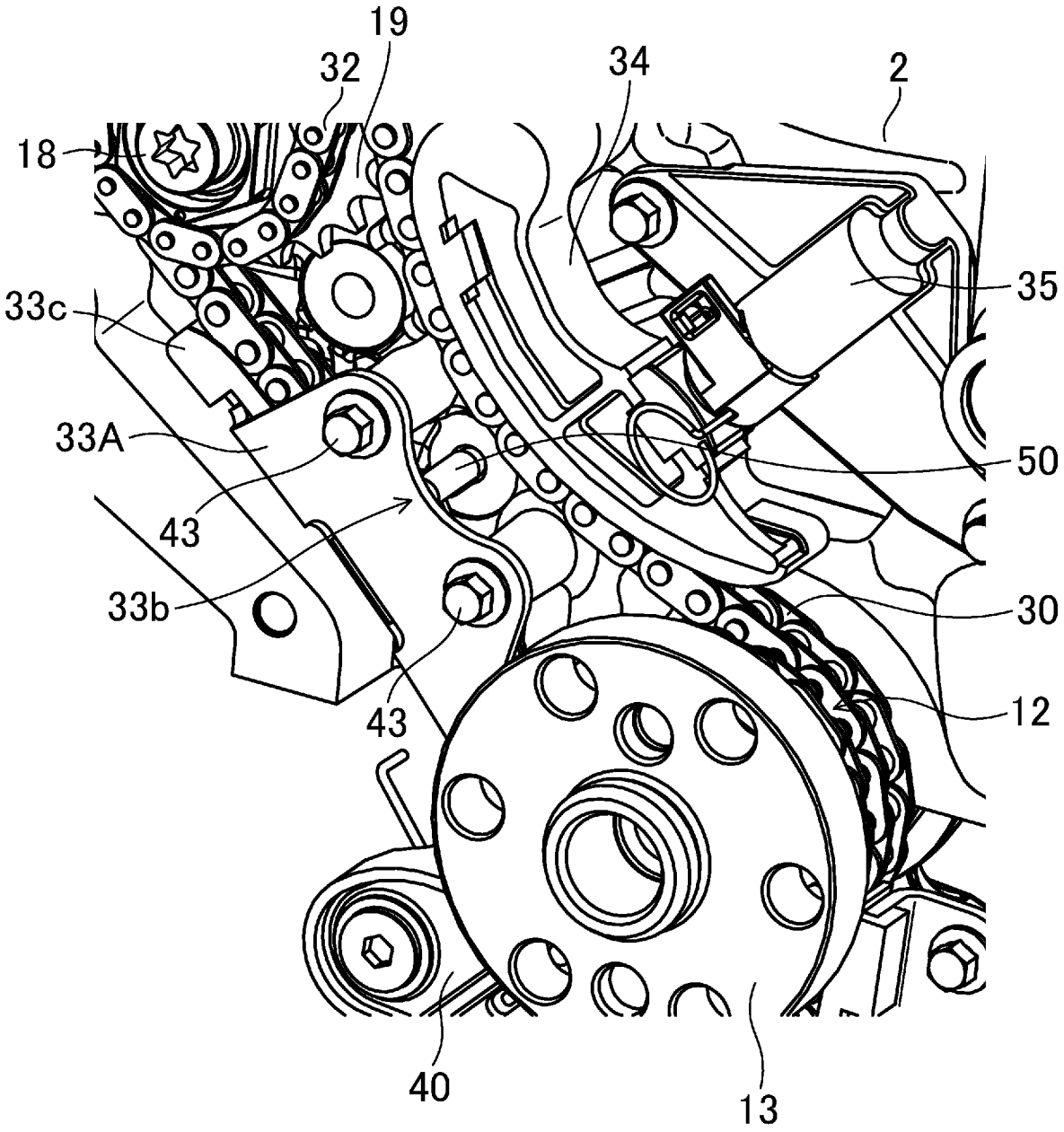
FIG. 7 is a partial perspective view illustrating an area including a timing chain guide for use in a timing chain system according to a second embodiment of the present invention.

FIG. 7 is a partial perspective view illustrating, on an enlarged scale, an area including a timing chain guide according to the second embodiment. In the second embodiment, components that are the same as those of the first embodiment will be identified by the corresponding reference characters, and detailed description thereof will be omitted herein.

As illustrated in FIG. 7, a timing chain guide 33A according to the second embodiment has a pressing part 33*b* that is in contact with the outer end portion of the oil jet 50 (the end portion of the oil jet 50 remote from the cylinder block 2), the pressing part 33*b* being formed in an area between two bolts 43. To be more specific, the inward surface (which is adjacent to the cylinder block 2) of the area between two bolts 43 in the timing chain guide 33A functions as the pressing part 33*b* for pressing the oil jet 50.

With the pressing part 33*b* configured in this manner, although the oil jet 50 cannot be arranged in the vicinity of the meshing point between the crankshaft sprocket wheel 11 and the timing chain 30, a pressing part 33*a* which would project from the timing chain guide 33A is no longer necessary, thereby achieving simple specifications and easy manufacturing of the timing chain guide 33A.

With the timing chain guide 33A having this configuration, just like the first embodiment, an oil supply structure for the timing chain 30 can be achieved, the oil supply structure being capable of supporting the oil jet 50 without using a bolt or the like, while reducing emission of a radiation sound from the timing chain cover 42 due to the oil jet 50.

(Other Embodiments)

The oil supply structure for the timing chain system according to each of the first and second embodiments includes the timing chain 30 on the transmission-facing side of the engine for vehicle. However, the present invention is also applicable to an oil supply system for a timing chain of the so-called front chain system, in which the timing chain 30 is arranged on a side remote from a transmission, i.e., on the front side of the engine.

INDUSTRIAL APPLICABILITY

The oil supply structure for the timing chain system according to the present invention is useful as an oil supply structure capable of reducing a radiation sound generated due to the supporting structure of an oil jet and, at the same time, capable of supporting easily the oil jet without depending on the structure of surrounding components such as the timing chain and the oil jet and without increasing the overall length of an engine body.

DESCRIPTION OF REFERENCE CHARACTERS

1 Engine (Engine Body)
2 Cylinder Block
3 Cylinder Head
10 Crankshaft
11 Crankshaft Sprocket Wheel (First Sprocket Wheel)
12 Oil Pump Chain Sprocket Wheel (Second Sprocket Wheel)
13 Flywheel Fastening Plate
18 Fuel Pump Drive Shaft
19 Fuel Pump Sprocket Wheel
20 Cam Chain Sprocket Wheel
21 Oil Pump Drive Shaft
22 Oil Pump Sprocket Wheel
30 Timing Chain
31 Oil Pump Chain
32 Cam Chain
33 Timing Chain Guide
33*a* Pressing Part
33A Timing Chain Guide
33*b* Pressing Part
33*c* Sliding Part
34 Timing Chain Tensioner Arm
35 Timing Chain Tensioner
42 Timing Chain Cover
42*a* Plate Support
43 Bolt
50 Oil Jet
50*a* Opening
50*b* First End Portion (One End Portion)
50*c* Second End Portion (Other End Portion)
50*d* Oil Injection Opening
50*e* Anti-Rotation Projection
50*f* Anti-Rotation Holder

The invention claimed is:

1. An oil supply structure for a timing chain system comprising: a timing chain configured to be driven by an output shaft of an engine body; and an oil jet configured to supply oil to the timing chain, wherein the engine body is provided with a timing chain cover covering a side, of the engine body, where the timing chain is arranged, the timing chain cover being spaced apart from the side of the engine body, the oil jet is a hollow member extending in an output shaft direction in which the output shaft of the engine body extends, the oil jet including therein an oil passage, a first end portion of the oil jet in the output shaft direction of the engine body is supported in the engine body, whereas a second end portion of the oil jet in the output shaft direction of the engine body extends toward the timing chain cover to an extent that the second end portion of the oil jet does not come into contact with the timing chain cover, a pressing part spaced apart from the timing chain cover in the output shaft direction is arranged between the second end portion of the oil jet and the timing chain cover in the output shaft direction, the pressing part is in contact with the second end portion of the oil jet, the engine body has a chain guide configured to guide traveling of the timing chain, the pressing part is formed integrally with the chain guide, and as viewed from above the engine body, a first end of the pressing part, which is adjacent to the chain guide, is more spaced apart from the engine body than a second end of the pressing part.

2. The oil supply structure for the timing chain system of claim 1, wherein the pressing part is comprised of a plate member.

3. An oil supply structure for a timing chain system comprising: a timing chain configured to be driven by an output shaft of an engine body; and an oil jet configured to supply oil to the timing chain, wherein the engine body is provided with a timing chain cover covering a side, of the engine body, where the timing chain is arranged, the timing chain cover being spaced apart from the side of the engine body, the oil jet is a hollow member extending in an output shaft direction in which the output shaft of the engine body extends, the oil jet including therein an oil passage, a first end portion of the oil jet in the output shaft direction of the engine body is supported in the engine body, whereas a second end portion of the oil jet in the output shaft direction of the engine body extends toward the timing chain cover to an extent that the second end portion of the oil jet does not come into contact with the timing chain cover, a pressing part spaced apart from the timing chain cover in the output shaft direction is arranged between the second end portion of the oil jet and the timing chain cover in the output shaft direction, the pressing part is in contact with the second end portion of the oil jet, and as viewed from above the engine body, a second end of the pressing part is displaced toward the timing chain cover in the output shaft direction relative to a first end of the pressing part.

4. The oil supply structure for the timing chain system of claim 1, wherein the chain guide has a bolt hole via which the chain guide is fastened to the engine body, the bolt hole is arranged in a portion of the chain guide, the portion is closer to the second end portion of the oil jet than the first end portion of the oil jet, and the pressing part extends from a part adjacent to the bolt hole.

5. The oil supply structure for the timing chain system of claim 1, wherein the pressing part has a width substantially equal to a width of the second end portion of the oil jet.

6. The oil supply structure for the timing chain system of claim 1, wherein the timing chain meshes with a first sprocket wheel arranged on the output shaft, and the oil jet is arranged adjacent to a meshing point between the timing chain and the first sprocket wheel.

7. An oil supply structure for a timing chain system comprising: a timing chain configured to be driven by an output shaft of an engine body; and an oil jet configured to supply oil to the timing chain, wherein the engine body is provided with a timing chain cover covering a side, of the engine body, where the timing chain is arranged, the timing chain cover being spaced apart from the side of the engine body, the oil jet is a hollow member extending in an output shaft direction in which the output shaft of the engine body extends, the oil jet including therein an oil passage, a first end portion of the oil jet in the output shaft direction of the engine body is supported in the engine body, whereas a second end portion of the oil jet in the output shaft direction of the engine body extends toward the timing chain cover to an extent that the second end portion of the oil jet does not come into contact with the timing chain cover, a pressing part spaced apart from the timing chain cover in the output shaft direction is arranged between the second end portion of the oil jet and the timing chain cover in the output shaft direction, the pressing part is in contact with the second end portion of the oil jet, the timing chain system is arranged on a transmission attaching side provided on one end of the engine body in the output shaft direction, the side of the engine body where the timing chain is arranged has a first sprocket wheel arranged on one end of the output shaft, and a flywheel fastening plate arranged on the output shaft and being closer to a transmission than the first sprocket wheel is, the first sprocket wheel and the flywheel fastening plate being located between the engine body and the timing chain cover in the output shaft direction, and the oil jet is arranged to overlap with the flywheel fastening plate as viewed in the output shaft direction.

8. The oil supply structure for the timing chain system of claim 7, wherein a second sprocket wheel coaxial with the first sprocket wheel is arranged between the first sprocket wheel and the flywheel fastening plate, and in the output shaft direction of the engine body, the second end portion of the oil jet is located closer to the engine body than the second sprocket wheel is.

* * * * *